US006205593B1

(12) United States Patent
Schaub, Jr.

(10) Patent No.: US 6,205,593 B1
(45) Date of Patent: Mar. 27, 2001

(54) LEG PROTECTOR

(76) Inventor: Wayne W. Schaub, Jr., 613 Tullulah St., River Ridge, LA (US) 70123

( * ) Notice: Subject to any disclaimer, the term of this patent is extended or adjusted under 35 U.S.C. 154(b) by 0 days.

(21) Appl. No.: 09/487,601

(22) Filed: Jan. 19, 2000

Related U.S. Application Data

(60) Provisional application No. 60/118,122, filed on Feb. 1, 1999.

(51) Int. Cl.[7] ..... A41D 17/00
(52) U.S. Cl. ..... 2/242; 2/22
(58) Field of Search ..... 2/22, 455, 23, 2/51, 911, 242, 216, 217, 231, 232, 233

(56) References Cited

U.S. PATENT DOCUMENTS

| | | | | |
|---|---|---|---|---|
| Re. 32,506 | * | 9/1987 | Hightower, Jr. | 2/22 |
| D. 278,567 | | 4/1985 | Rasmussen . | |
| D. 361,087 | | 8/1995 | Anson . | |
| D. 361,161 | * | 8/1995 | Dama | D29/121 |
| 529,352 | * | 11/1894 | Bailey | 2/22 |
| 562,784 | * | 6/1896 | Fisher | 2/22 |
| 783,519 | * | 2/1905 | Hamilton | 2/22 |
| 1,527,825 | * | 2/1925 | Baggerud | 2/23 |
| 1,594,086 | * | 7/1926 | Arnold | 36/2 |
| 1,621,153 | * | 3/1927 | Bunnenberg | 2/22 |
| 1,654,083 | * | 12/1927 | Jantzen | 2/123 |
| 2,125,451 | * | 8/1938 | Kolliner | 36/2 |
| 2,279,663 | * | 4/1942 | Dillon | 2/123 |
| 2,406,090 | * | 8/1946 | Mas | 36/2 |
| 2,429,507 | * | 10/1947 | Ballenger | 36/2 |
| 2,544,065 | | 3/1951 | Carr . | |
| 2,637,916 | * | 5/1953 | Pagano | 36/2 |
| 2,834,021 | * | 5/1958 | Landauer | 2/273 |
| 3,128,565 | * | 4/1964 | Graham et al. | 36/2 |
| 3,153,864 | | 10/1964 | Brewer . | |
| 3,269,036 | * | 8/1966 | Parker et al. | 36/2 |
| 3,306,610 | * | 2/1967 | Biggs, Jr. et al. | 272/57 |
| 4,306,315 | | 12/1981 | Castiglia . | |
| 4,461,098 | * | 7/1984 | Diegelman | 36/2 R |
| 4,542,597 | * | 9/1985 | Baptista et al. | 36/2 R |
| 4,809,447 | * | 3/1989 | Pacanowsky et al. | 36/9 R |
| 4,856,207 | * | 8/1989 | Datson | 36/2 R |
| 4,964,176 | * | 10/1990 | Previdi | 2/242 |
| 4,989,273 | * | 2/1991 | Cromartie | 2/231 |
| 5,005,215 | * | 4/1991 | McIlquham | 2/22 |
| 5,010,597 | * | 4/1991 | Glover | 2/242 |
| 5,031,247 | * | 7/1991 | Carter | 2/242 |
| 5,170,503 | | 12/1992 | Hightower, Jr. et al. . | |
| 5,171,503 | * | 12/1992 | Hightower, Jr. et al. | 2/22 |
| 5,173,967 | * | 12/1992 | Carter | 2/242 |
| 5,524,349 | | 6/1996 | Dolin . | |
| 5,570,470 | | 11/1996 | Miller . | |
| 5,613,250 | * | 3/1997 | Bell | 2/242 |
| 5,814,003 | * | 9/1998 | Knox et al. | 602/63 |
| 5,815,948 | * | 10/1998 | Dzielak | 36/2 R |
| 5,896,676 | * | 4/1999 | Barousse | 36/2 R |
| 5,970,525 | * | 10/1999 | Gallinot et al. | 2/242 |

FOREIGN PATENT DOCUMENTS 2074438 11/1981 (GB) .

* cited by examiner

*Primary Examiner*—John J. Calvert
*Assistant Examiner*—Alissa L. Hoey
(74) *Attorney, Agent, or Firm*—Richard C. Litman

(57) ABSTRACT

A legging adapted for protecting a wearer's leg from flying debris. The legging is defined by a substantially tubular body having an first end and a second end. The substantially tubular body is made of a flexible fabric for enabling the tubular body to fit comfortably around a lower portion of wearer's leg while permitting air to circulate around the leg. The legging is further defined by a suspension means attached to the first end for enabling said first end to fit snugly around a wearer's leg just above the knee.

2 Claims, 3 Drawing Sheets

LEG PROTECTOR

CROSS-REFERENCE TO RELATED APPLICATION

This application claims the benefit of U.S. Provisional Patent Application Ser. No. 60/118,122, filed Feb. 1, 1999.

BACKGROUND OF THE INVENTION

1. Field of the Invention

The present invention generally relates protective clothing, more specifically, to a leg protector for use with grass and weed trimmers.

2. Description of Related Art

In recent years powered, hand-held, weed and grass trimmers, utilizing a rotating filament to accomplish the trimming, have come into wide spread use. Such trimmers are generally characterized by an elongated body in the form of a tubular shaft having forward and rearward ends. A spool of cutting filament is mounted at the forward end of the trimmer and a length or segment of filament is unwound from the spool so as to perform the cutting action as the spool is rotated at high speed. In some trimmer models the forward end of the trimmer is provided with a shield facing the operator to protect the operator from the rotating filaments as well as sticks, gravel, stones and other debris which might otherwise be thrown toward the operator by the rotating filament. However, in most trimmers, the shield does not extend in a full circle, and thus, is exposed as it does its work. Thus, grass and weed clippings and other debris may reach the operator from the unshielded portions of the trimmer. By the very nature of a weed trimmer, no shield is capable of preventing all clippings and debris from reaching the operator.

Lawn trimmer shields for partially protecting the operator from clippings and other debris and for protecting trees, plants, and the like from damage from being struck by the rotating filament of the trimmer are well known. Examples of such shields may be seen in the following references may be seen in the following references: U.S. Pat. No. 5,077,898, issued to James J. Hartwig on Jan. 7, 1992; U.S. Pat. No. 5,010,720, issued to Louis V. Corsi on Apr. 30, 1991; U.S. Pat. No. 5,048,187, issued to Patrick J. Ryan on Sep. 17, 1991; U.S. Pat. No. 4,845,889, issued to Jess W. Taylor on Jul. 11, 1989; U.S. Pat. No. 4,630,371, issued to Andrew J. Graham on Dec. 23, 1986; and U.S. Pat. No. 4,751,422, issued to Randall A. Beihoffer on Oct. 9, 1984. U.S. Pat. No. 5,524,349 issued to Dolin on Jun. 11, 1996 describes a protective shield for a grass and weed trimmer which helps prevent grass and weed clippings and other debris from reaching the operator. However, none of the above mentioned inventions describe a substantially tubular shield capable of being worn around a wearer's leg for protecting the leg from injury caused by flying debris.

Several inventions are known to describe a substantially tubular shield for protecting a wearer's legs. For example, U.S. Patent No. Des. 278,567 issued to Rasmussen on Apr. 30, 1985 discloses an ornamental design for a martial arts leg and foot protector. U.S. Patent No. Des. 361,161 issued to Dama on Aug. 8, 1995 discloses an ornamental design for a knee protector. U.S. Patent No. Des. 362,087 discloses an ornamental design for a shin guard.

U.S. Pat. No. 1,594,086 issued on Jul. 27, 1926 to C. F. Arnold describes a sportsman's wading stocking. U.S. Pat. No. 3,153,864 issued on Oct. 27,1964 to J. A. Brewer describes an improved protective legging for use in industrial and other hazardous locations. U.S. Pat. No. 3,269,036 issued on Aug. 30, 1966 to M. Parker et al. describes a protective legging for protecting a wearer's legs from snake-infested and heavy undergrowth areas. U.S. Pat. No. 4,306,315 issued to Castiglia on Dec. 22, 1981 describes a shin guard adapted to tightly surround a wearer's legs. U.S. Pat. No. 5,170,503 issued to Hightower, Jr. et al. on Dec. 15, 1992 describes a protective garment for shielding a wearer from snake bites upon the lower portion of the leg. U.S. Pat. No. 5,173,967 issued to Carter on Dec. 29, 1992 describes a protective leg and arm covering manufactured from a single piece of material. U.S. Pat. No. 5,570,470 issued to Miller on Nov. 5, 1996 describes a shin protector defined by a rectangular, flexible, impervious body. U.S. Pat. No. Re. 32,506 issued to Hightower, Jr. on Sep. 22, 1987 describes a protective garment for shielding a wearer from snake bites.

None of the above inventions describe a leg protector defined by a substantially tubular body made of a flexible material, the substantially tubular body having attached at one end thereof an elastic band for enabling the body to fit snugly around a wearer's leg just above the knee. Moreover, none of the above inventions describe a leg protector made of a flexible material, the protector being defined by a substantially tubular body having an elastic band attached to one end thereof and a weight member attached to the other end for forming a leg shield normally subjected to tension forces when being worn around a wearer's leg.

None of the above inventions and patents, taken either singly or in combination, is seen to describe the instant invention as claimed.

SUMMARY OF THE INVENTION

The present invention is a shield apparatus adapted for shielding a wearer's leg from flying debris. The shield apparatus is defined by a substantially tubular body having an first end and a second end. The tubular body is made of a flexible fabric for enabling the tubular body to comfortably enclose a wearer's leg while for permitting some air to circulate freely through the body. The shield apparatus is further defined by a suspension means attached to the first end for enabling said first end to be suspended from a wearer's leg just above the knee.

Accordingly, it is a principal object of the invention to provide a leg protector that is light weight.

It is another object of the invention to provide a leg protector that is porous for enabling air to circulate freely around a wearer's leg while being worn.

Still another object of the invention is to provide a leg protector capable of fitting snugly around a wearer's leg just above the knee.

Yet another object of the invention to provide a leg protector which when subjected to a repetitive impact absorbs the impact of flying debris.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
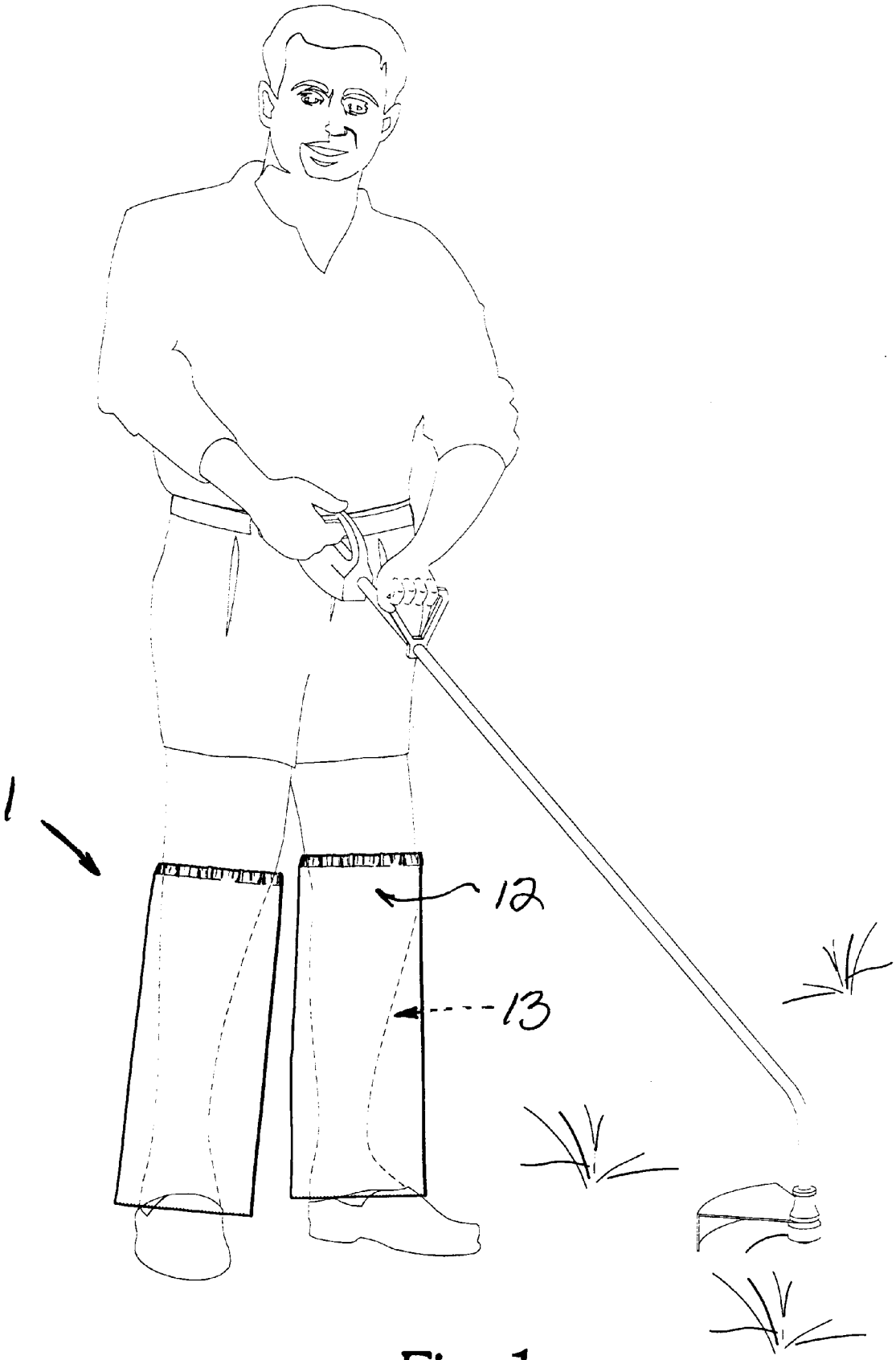
FIG. 1 is an environmental, perspective view of a leg protector according to the present invention.
Figure 2:
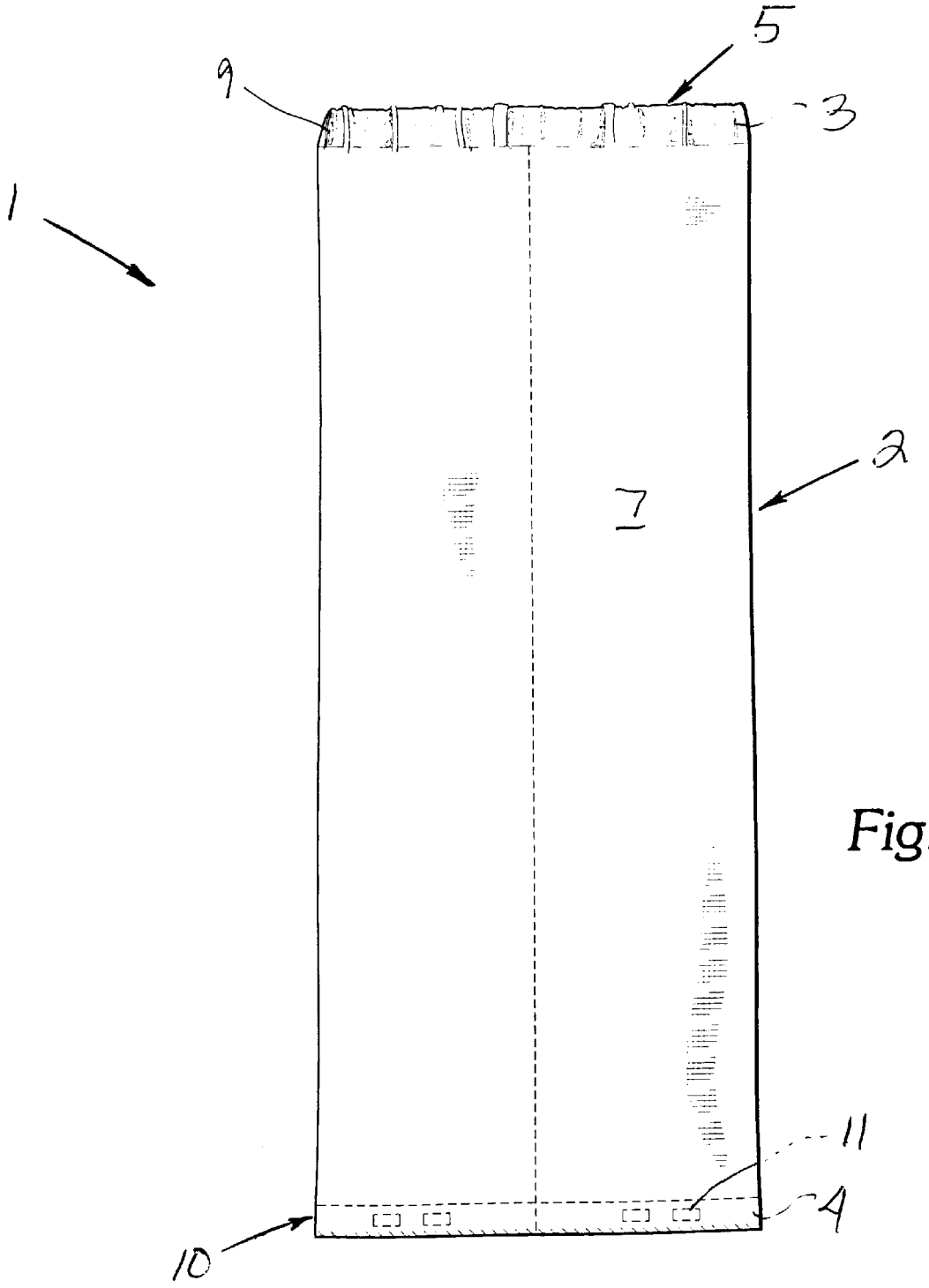
FIG. 2 is a side elevational view of a leg protector according to a preferred embodiment.
Figure 3:
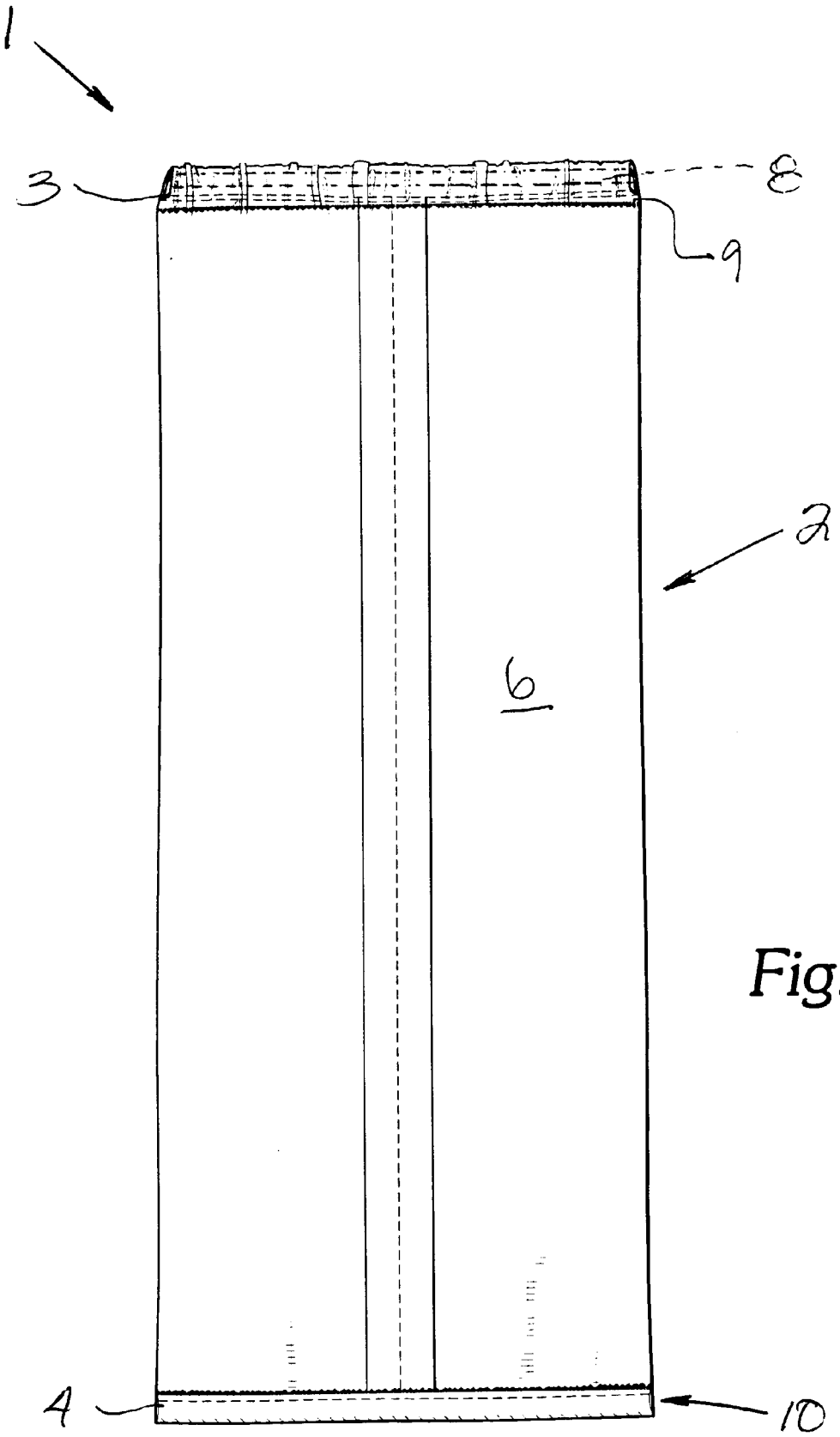
FIG. 3 is a longitudinal section view of the leg protector shown in FIG. 2.

The present invention is a leg protector apparatus for shielding a wearer's leg from flying debris scattered by lawn trimming equipment. FIG. 1 shows an environmental perspective view of a leg protector apparatus 1 according to a preferred embodiment. Further details relating to the construction of the leg protector apparatus 1 may best be appreciated by referring to FIGS. 2 and 3.

Preferably, the leg protector apparatus 1 is defined, in part, by a substantially tubular body 2 having a first end 3 and a second end 4. The substantially tubular body 2 is made from a flexible fabric material for enabling the substantially tubular body 2 to lay comfortably around a wearer's leg 13 while the wearer is engaged in conventional lawn care activities. The substantially tubular body 2 is defined by an inner surface 6 and an outer surface 7. Any one of several well-known materials used for conventional pants may be used to make the substantially tubular body 2. For example, a cotton, polyester, or a cotton/polyester blend may be used.

Additionally, the particular fabric material used may vary from a lightweight material for use in hot climates to a heavy weight material for use in cool environments. Accordingly, the substantially tubular body 2 may be constructed to effectively enable the leg protector apparatus 1 to shield a leg 13 from flying debris while not imposing an unnecessary burden on a wearer from the weight of the substantially tubular body 2.

A suspension means 5 is attached to the substantially tubular body 2 at the first end 3 for enabling the substantially tubular body 2 to be suspended from a wearer leg 13 at the first end 3. Preferably, the suspension means 5 is attached over a substantial portion of the inner surface 6 at to the first end 3 for enabling the first end 3 to be suspended from around a wearer's leg 13. The present invention anticipates the suspension means 5 being an elastic band, a lace, or any other well-known means for gathering a flexible body together around an wearer's body.

According to a first preferred embodiment, a first hem 9 is formed around the first end 3 for creating a finished look at the first end 3. The first hem 9 is a conventional hem formed by folding one end of the substantially tubular body 2 over itself and stitching the two lengths of fabric together. An elastic band 8 may be inserted inside the first hem 9 for enabling the first end 3 to be gathered around a wearer's leg 13 just above the wearer's knee 12. Thereby, the leg protector 1 can be selectively suspended from a wearer's leg 13 just above the knee 12. Additionally, placement of the elastic band 8 inside the first hem 9 affixes the elastic band 8 to the substantially tubular body 2 at the first end 3.

Similarly, a second hem 10 may be formed at the second end 4 for creating a finished look at the second end 4. Preferably, at least one weight member 11 is inserted inside of the second hem 10 for adding weight to the second end 4. Thereby, the weight member 11 helps the second end 4 to hang and enable the substantially tubular body 2 to better absorb impact from heavy debris.

It is to be understood that the present invention is not limited to the sole embodiments described above, but encompasses any and all embodiments within the scope of the following claims.

I claim:

1. A protective legging adapted to protect a wearer's legs from flying debris, said legging comprising:

a substantially tubular body having a first end and a second end;

a first hem defining said first end;

a second hem defining said second end;

wherein said substantially tubular body is made of a flexible fabric for enabling the tubular body to comfortably enclose one of the wearer's legs and for enabling air to circulate through said tubular body; and first means formed around said first end for enabling said first end to be selectively suspended from a wearer's leg just above the knee;

said first means comprising an elastic band enclosed in said first hem for enabling said first end to fit snugly around the wearer's leg;

second means positioned at said second end for enabling said second end to hang freely around a wearer's lower leg and enabling said tubular body to better absorb impact from heavy debris;

said second means comprising a weight member enclosed in said second hem.

2. The legging recited in claim 1, where said substantially tubular body has a height of approximately 1 foot 9 inches and a diameter of approximately 10 inches.

* * * * *